US011530595B2

(12) United States Patent
Aker et al.

(10) Patent No.: US 11,530,595 B2
(45) Date of Patent: Dec. 20, 2022

(54) SYSTEMS AND METHODS FOR HORIZONTAL WELL COMPLETIONS

(71) Applicant: Schlumberger Technology Corporation, Sugar Land, TX (US)

(72) Inventors: Haydar Gokhan Aker, Moscow (RU); Oleg Valeryevich Zhdaneev, Moscow (RU); Gokhan Saygi, Moscow (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/270,138

(22) PCT Filed: Aug. 24, 2018

(86) PCT No.: PCT/RU2018/000561

§ 371 (c)(1),
(2) Date: Feb. 22, 2021

(87) PCT Pub. No.: WO2020/040656

PCT Pub. Date: Feb. 27, 2020

(65) Prior Publication Data

US 2021/0238954 A1 Aug. 5, 2021

(51) Int. Cl.

| | |
|---|---|
| ***E21B 33/14*** | (2006.01) |
| ***E21B 7/04*** | (2006.01) |
| ***E21B 43/26*** | (2006.01) |

(52) U.S. Cl.

CPC ..... *E21B 33/14* (2013.01); *E21B 7/04* (2013.01); *E21B 43/26* (2013.01)

(58) Field of Classification Search

CPC ..... E21B 33/14; E21B 7/04; E21B 43/26
See application file for complete search history.

(56) References Cited

U.S. PATENT DOCUMENTS

| | | | |
|---|---|---|---|
| 3,789,926 | A | 2/1974 | Henley et al. |
| 4,246,958 | A | 1/1981 | Sagan et al. |

(Continued)

FOREIGN PATENT DOCUMENTS

| | | | |
|---|---|---|---|
| CN | 201568013 | U | 9/2010 |
| CN | 105089529 | A | 11/2015 |

(Continued)

OTHER PUBLICATIONS

M.O. Ashrafian et al. Improvement of Constructions for Bottom Holes. M. Nedra, 1987 (Year: 1987).*

(Continued)

*Primary Examiner* — Crystal J. Lee
(74) *Attorney, Agent, or Firm* — Matthew Goode

(57) ABSTRACT

The present disclosure generally relates to systems and methods for horizontal well completions, including dual monobore completions, without certain well intervention operations. More specifically, the embodiments described herein generally eliminate certain well intervention operations, such as cleaning of cementing-related equipment and accessories (e.g., plugs, balls, and so forth), performing logging operations, running and cementing intermediate casings, and so forth. In certain embodiments, a production casing may be run into a wellbore and cemented into place within the wellbore directly adjacent a surface casing of the well. In certain embodiments, the production casing comprises first and second tubular sections longitudinally separated by an intermediate tapered section.

17 Claims, 5 Drawing Sheets

(56) References Cited

U.S. PATENT DOCUMENTS

| | | | |
|---|---|---|---|
| 4,669,541 | A | 6/1987 | Bissonnette |
| 5,038,862 | A | 8/1991 | Giroux et al. |
| 5,318,118 | A | 6/1994 | Duell |
| 5,348,089 | A | 9/1994 | Brandell et al. |
| 5,443,124 | A | 8/1995 | Wood et al. |
| 5,711,372 | A | 1/1998 | Stokley |
| 5,890,537 | A | 4/1999 | Lavaure et al. |
| 6,098,710 | A | 8/2000 | Rhein-Knudsen et al. |
| 6,755,256 | B2 | 6/2004 | Murley et al. |
| 7,063,152 | B2 | 6/2006 | Yeo et al. |
| 7,069,992 | B2 | 7/2006 | Lewis et al. |
| 7,073,599 | B2 | 7/2006 | Smith |
| 7,284,619 | B2 | 10/2007 | Stokley et al. |
| 7,373,980 | B2 | 5/2008 | Lewis et al. |
| 7,413,020 | B2 | 8/2008 | Carter et al. |
| 7,464,758 | B2 | 12/2008 | Yeo et al. |
| 7,654,324 | B2 | 2/2010 | Chase et al. |
| 7,669,653 | B2 | 3/2010 | Craster et al. |
| 7,857,052 | B2 | 12/2010 | Giroux et al. |
| 8,162,047 | B2 | 4/2012 | Chase et al. |
| 8,215,404 | B2 | 7/2012 | Makowiecki et al. |
| 8,439,113 | B2 | 5/2013 | Boyle |
| 8,657,004 | B2 | 2/2014 | Zhou |
| 8,800,655 | B1 | 8/2014 | Bailey |
| 9,080,422 | B2 | 7/2015 | Melenyzer |
| 9,856,714 | B2 | 1/2018 | Giroux |
| 9,869,157 | B2 | 1/2018 | Sevadjian et al. |
| 9,945,206 | B2 | 4/2018 | Zhou |
| 9,970,258 | B2 | 5/2018 | Barannikow et al. |
| 10,053,954 | B2 | 8/2018 | Stautzenberger et al. |
| 10,352,140 | B2 | 7/2019 | Parlin et al. |
| 10,378,311 | B2 | 8/2019 | Bocangel Calderon et al. |
| 10,428,607 | B2 | 10/2019 | Zhou |
| 2013/0264054 | A1* | 10/2013 | East ..... E21B 47/00 166/270.1 |

FOREIGN PATENT DOCUMENTS

| | | | |
|---|---|---|---|
| CN | 107975352 | A | 5/2018 |
| RU | 52087 | U1 | 3/2006 |
| RU | 2492323 | C1 | 9/2013 |
| RU | 2625126 | C1 | 7/2017 |
| WO | 2017190010 | A1 | 11/2017 |
| WO | 2021097017 | | 5/2021 |

OTHER PUBLICATIONS

Pak M.S. et al., StingBlade Groundbreaking Technology. "Neft y Gas" journal, May 17, 2017 (Year: 2017).*

International Search Report and Written Opinion issued in the PCT Application PCT/RU2018/000561, dated May 16, 2019 (6 pages).

International Search Report and Written Opinion issued in the PCT Application PCT/US2020/060118, dated Mar. 8, 2021 (11 pages).

International Preliminary Report on Patentability issued in the PCT Application PCT/RU2018/000561, dated Mar. 11, 2021 (6 pages).

Ashrafian et al., Improvement of Constructions for Bottom Holes, M. Nedra, 1987 (17 pages with English Translation).

Pak M.S. et al., StingBlade Groundbreaking Technology, downloaded on Apr. 29, 2019 (9 pages with English Translation).

Koltypin, O. A. et al., (2014) Implement an Integrated approach at the completion of horizontal wells with multi-stage hydraulic francturing in LLC RN-Yuganskneftegaz, Scientific and Technical Bulletin of OAO OC Rosneft, Appendix, Issue 2, 2014, pp. 36-41.

* cited by examiner

SYSTEMS AND METHODS FOR HORIZONTAL WELL COMPLETIONS

BACKGROUND

The present disclosure generally relates to well completions and, more particularly, to systems and methods for horizontal well completions, including dual monobore completions, without certain well intervention operations, such as cleanout operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A wellbore drilled into a geological formation may be targeted to produce oil and/or gas from certain zones of a geological formation. In particular, in order to selectively produce and treat certain zones of a geological formation, certain wells may be directionally drilled (e.g., as opposed to being strictly vertically drilled) such that the various zones may be reached by the wellbore. Indeed, certain wells are horizontally drilled, which is a subset of directionally drilled wells where the departure of the wellbore from vertical exceeds approximately 80 degrees, for example. Because a horizontal well typically penetrates a greater length of the geological formation, it can offer significant production improvement over a strictly vertical well. To prevent different zones from interacting with one another via the wellbore, and to prevent fluids from undesired zones from entering the wellbore, the wellbore may be completed by placing a cylindrical casing into the wellbore and cementing the casing in place. However, in the interest of increasing efficiency of horizontal well completions, there is a need to simplify the well completion operations.

SUMMARY

A summary of certain embodiments described herein is set forth below. It should be understood that these aspects are presented merely to provide the reader with a brief summary of these certain embodiments and that these aspects are not intended to limit the scope of this disclosure. Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

One embodiment of the present disclosure includes a method that includes drilling a conductor section of a wellbore of a well. The method also includes running and setting conductor casing within the wellbore. The method further includes directionally drilling into a surface section of the wellbore from the conductor section of the wellbore. In addition, the method includes running and setting surface casing within the wellbore. The method also includes directionally drilling into a production section of the wellbore to the surface section of the wellbore. The method further includes performing a reaming/conditioning trip to the surface section of the wellbore. In addition, the method includes running and setting production casing within the wellbore directly adjacent the surface casing to complete the well. The production casing comprises a tapered section. The production casing also includes multistage fracturing equipment disposed therein. The well is completed without cleaning out of cementing-related equipment from the casing of the wellbore.

Another embodiment of the present disclosure includes a method that includes drilling a conductor section of a wellbore of a well. The method also includes running and setting conductor casing within the wellbore. The method further includes directionally drilling into a surface section of the wellbore from the conductor section of the wellbore. In addition, the method includes running and setting surface casing within the wellbore. The method also includes directionally drilling into a production section of the wellbore to the surface section of the wellbore. The method further includes performing a reaming/conditioning trip to the surface section of the wellbore. In addition, the method includes running and setting production casing within the wellbore directly adjacent the surface casing to complete the well. The production casing includes multistage fracturing equipment disposed therein. The well is completed without cleaning out of cementing-related equipment from the casing of the wellbore, without running and setting intermediate casing within the surface casing before running and setting the production casing within the wellbore, and without suspending a production liner from the production casing to complete the well.

Another embodiment of the present disclosure includes a method that includes drilling a conductor section of a wellbore of a well. The method also includes running and setting conductor casing within the wellbore. The method further includes directionally drilling into a surface section of the wellbore from the conductor section of the wellbore. In addition, the method includes running and setting surface casing within the wellbore. The method also includes directionally drilling into a production section of the wellbore to the surface section of the wellbore. The method further includes performing a reaming/conditioning trip to the surface section of the wellbore. In addition, the method includes running and setting production casing within the wellbore directly adjacent the surface casing to complete the well. The production casing comprises a tapered section. The production casing also includes multistage fracturing equipment disposed therein. The well is completed without cleaning out of cementing-related equipment from the casing of the wellbore, without running and setting intermediate casing within the surface casing before running and setting the production casing within the wellbore, without performing cable-conveyed logging operations relating to the wellbore before running and setting the production casing within the wellbore; and without suspending a production liner from the production casing to complete the well.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
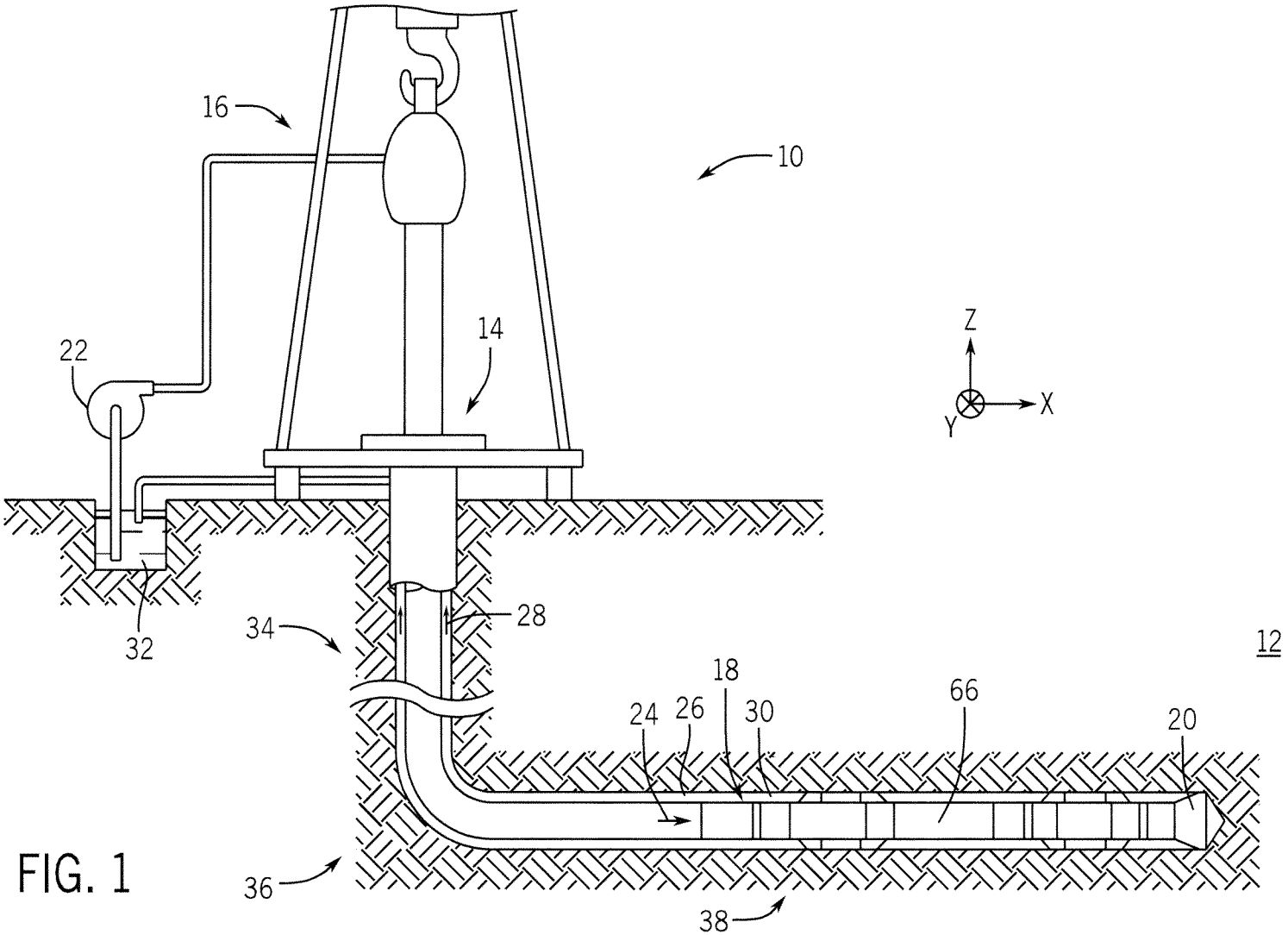
FIG. 1 is a schematic diagram of a drilling system wherein a well is drilled through a geological formation to produce a wellbore, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "top" and "bottom," and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

The present disclosure generally relates to systems and methods for horizontal well completions, including dual monobore completions, without certain well intervention operations. More specifically, the embodiments described herein generally eliminate certain well intervention operations, such as cleaning out of cementing-related equipment and accessories (e.g., plugs, balls, and so forth) from within the various casing of the well, performing cable-conveyed logging operations, running and cementing intermediate casings, and so forth. In certain embodiments, a production casing may be run into a wellbore and cemented into place within the wellbore directly adjacent a surface casing of the well. In certain embodiments, the production casing comprises first and second tubular sections longitudinally separated by an intermediate tapered section.

To help illustrate the techniques described herein, FIG. 1 is a schematic diagram of a drilling system 10 wherein a well is drilled through a geological formation 12 to produce a wellbore 14, in accordance with embodiments of the present disclosure. At the surface 16, a drill string 18 that includes a drill bit 20 at its lower end is rotated into the geological formation 12. As the drill bit 20 rotates, a "mud" pump 22 forces drilling fluid 24, which may be referred to as "mud" or "drilling mud," through the drill string 18 to the drill bit 20. The drilling fluid 24, which is used to cool and lubricate the drill bit 20, exits the drill string 18 through the drill bit 20. The drilling fluid 24 may carry drill cuttings 26 out of the wellbore 14 as the drilling fluid 24 flows back to the surface 16. The flow of the drilling fluid 24 out of the wellbore 14 is shown by arrows 28, illustrating that the drilling fluid 24 exits the wellbore 14 through an annulus 30 between the drill string 18 and the geological formation 12. At the surface 16, the drilling fluid 24 is filtered and conveyed back to a mud pit 32 for reuse.

The environment of the wellbore 14 may vary widely depending upon the location and situation of the geological formation 12. For example, rather than a land-based operation, the wellbore 14 may be drilled into the geological formation 12 under water of various depths, in which case the surface 16 may include topside equipment such as an anchored or floating platform, and some of the components used may be positioned at or near a point where the wellbore 14 enters the earth beneath a body of water. Moreover, in the example illustrated in FIG. 1, the wellbore 14 includes a substantially vertical section 34 (e.g., that includes a conductor section having conductor casing, as described herein) that is deviated from via a directionally drilled section 36 (e.g., that includes a surface section having surface casing, as described herein) that extends into a substantially horizontal section 38 (e.g., that includes a production section having production casing and, in certain situations, an intermediate section between the surface section and the production section, which includes intermediate casing, as described herein). In certain situations, a production liner may be hung from the production casing. However, as described in greater detail herein, embodiments of the present disclosure include a production section having production casing that is directly adjacent a surface section having surface casing, without an additional production liner hanging from the production casing. In general, as illustrated in FIG. 1, the substantially horizontal section 38 includes one or more downhole tools 66 that, for example, include a specifically designed crossover, special stage cementing equipment, multistage fracturing equipment, and so forth, disposed within production casing, intermediate casing, and/or production liners, as described herein. In particular, the embodiments described herein include a production casing that includes at least one tapered section that facilitates the production casing being disposed directly adjacent surface casing, wherein the production casing includes multistage fracturing equipment disposed therein.

Figure 3:
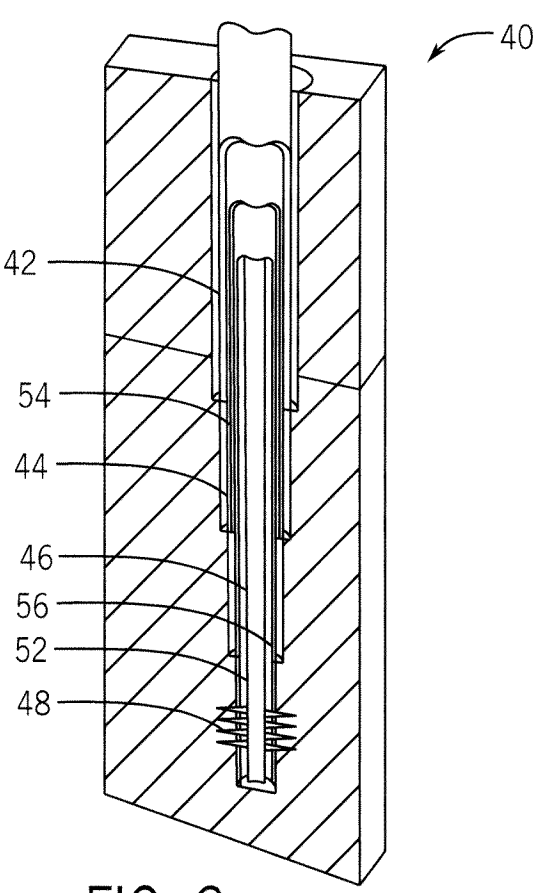
FIG. 3 is a schematic diagram of a well completion in a drilling system.
Figure 2:
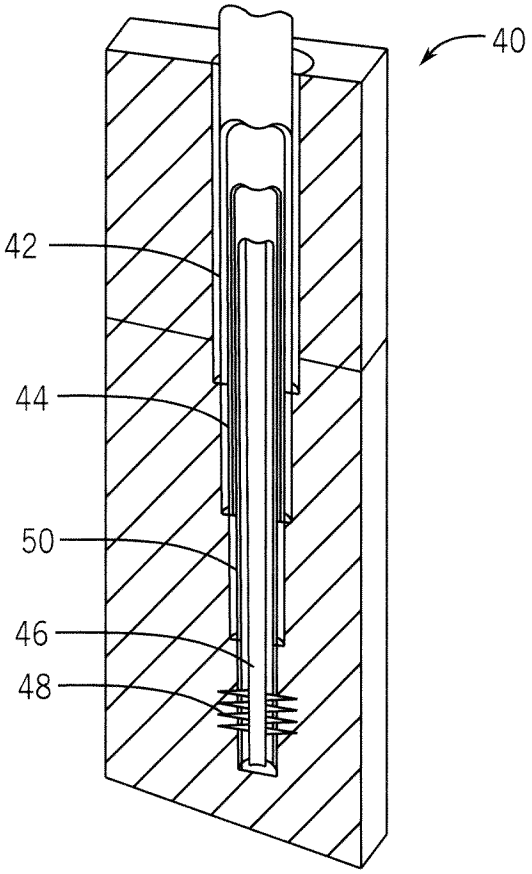
FIG. 2 is a schematic diagram of a well completion in a drilling system.

To further illustrate the functionality of the embodiments described herein, a brief discussion of the interaction between conductor casing, surface casing, intermediate casing, production casing, and production liners in a well completion are shown in FIGS. 2 and 3. As illustrated in FIG. 2, the well completion 40 includes conductor casing 42, which is typically run into the wellbore 14 and set (e.g., cemented into place) within the wellbore 14 first, particularly, near the surface 16 in land wells, to prevent the sides of the borehole from caving into the wellbore 14. In general, the conductor casing 42 has a relatively large diameter (e.g., 36 inches, or even greater) than, but is typically shorter in length than any of the other sections of casing.

Next, surface casing 44 is run into the wellbore 14 and set (e.g., cemented into place) within the conductor casing 42. The surface casing 44 also has a relatively large diameter (e.g., 32 inches, or even greater) that is smaller (e.g., 4-6 inches smaller) than the conductor casing 42. In general, the surface casing 44 is typically set in place only down to relatively shallow portions of the geological formation 12 and serves the purposes of, among other things, protecting near-surface portions of the geological formation 12, providing minimal pressure integrity so that certain equipment, such as a blowout preventer (BOP), may be attached to the top of the surface casing 44 after the surface casing 44 is set into place, and providing structural strength for the other casing strings that are suspended from within the surface casing 44.

Production casing 46 is run into the wellbore 14 and set (e.g., cemented into place) within the surface casing 44. The production casing 46 is set within the reservoir of the geological formation 12, within which the primary completion components are installed. For example, the primary completion components facilitate the functionality of the particular type or design of completion. For example, the primary completion components may include perforating equipment for creating perforations 48 through the production casing 46 (and production liners, in certain situations) through which oil and/or gas may flow from the geological formation 12 into the wellbore 14, electrical submersible pumps (ESPs) multistage fracturing equipment for providing additional pressure to move the oil and/or gas up through the wellbore 14, and multistage fracturing equipment, among other types of components.

As illustrated in FIG. 2, in certain situations, the well completion 40 may include intermediate casing 50 that is run into the wellbore 14 and set (e.g., cemented into place) within the surface casing 44 but before the production casing 46 is run into the wellbore 14 and set (e.g., cemented into place) within the intermediate casing 50. In general, the intermediate casing 50 provides protection against caving of relatively weak or abnormally pressure formations. As described herein, the embodiments of the present disclosure facilitate the elimination of intermediate casing 50 such that the production casing 46 is run into the wellbore 14 and set (e.g., cemented into place) within, and directly adjacent, the surface casing 44.

In addition, as illustrated in FIG. 3, in certain situations, production liners 52 may be suspended from inside the bottom of the lowest string of production casing 46. As such, in contrast to the conductor casing 42, surface casing 44, production casing 46, and intermediate casing 50, the production liners 52 do not extend all the way to the top of the wellbore 14 although, in certain situations, a liner tie-back string 54 may be used to indirectly couple the production liner 52 to the top of the wellbore 14. Other than this difference, production liners 52 are typically not much different than production casing 46 and are often used to reduce the amount of steel that needs to be employed in the wellbore 14. However, the use of production liners 52 introduces other costs, such as the need for additional tools, complexities, and risks. As described herein, the embodiments of the present disclosure also facilitate the elimination of separate production liners 52 insofar as the production casing 46 described herein represent a combined casing/liner design wherein the production casing 46 includes at least one tapered section that reduces a diameter of a first (e.g., axially upper) section of the production casing 46, which is set in place within the surface casing 44, to a second (e.g., axially lower) section of the production casing 46.

Figure 4:
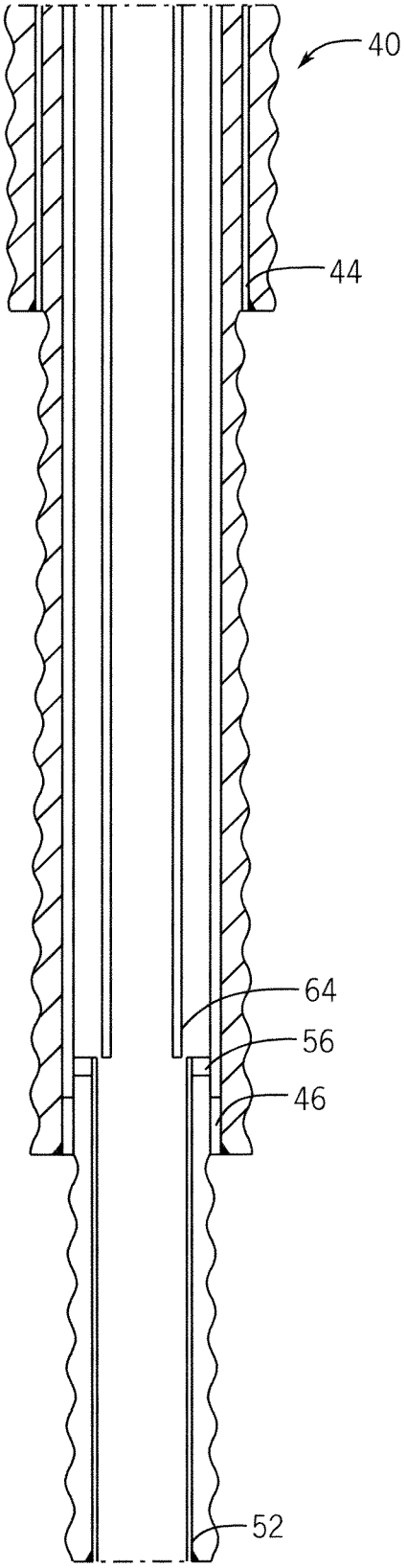
FIG. 4 is a schematic diagram of a lower portion of a well completion in a drilling system.
Figure 5:
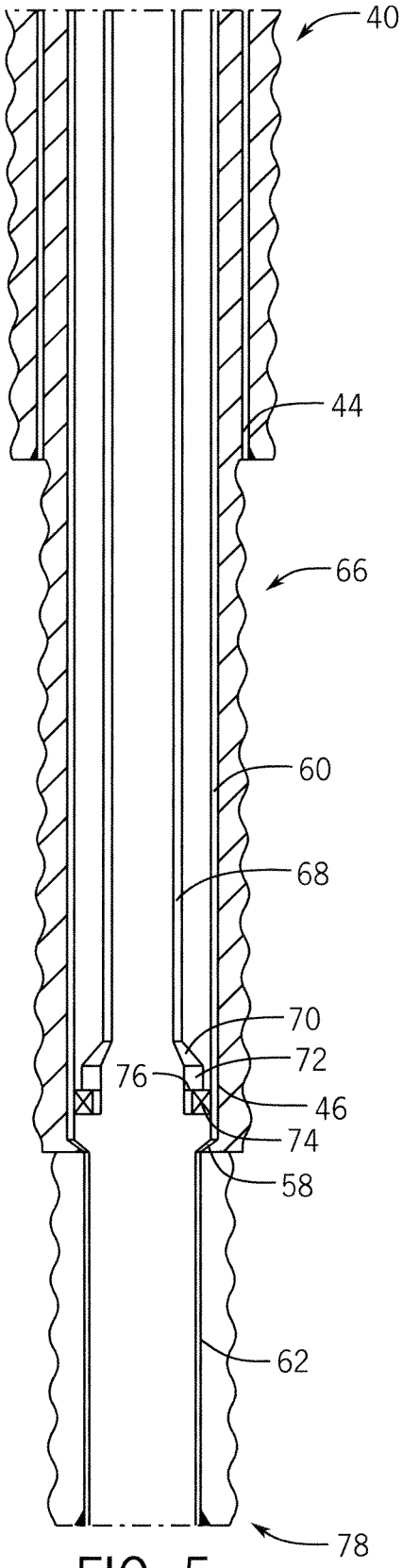
FIG. 5 is a schematic diagram of a lower portion of a well completion in a drilling system, in accordance with embodiments of the present disclosure.

To further illustrate the embodiments of the present disclosure, FIGS. 4 and 5 illustrate two different well completions 40, a first well completion 40 (e.g., illustrated in FIG. 4) having conventional surface casing 44, production casing 46, and a production liner 52 suspended from inside the bottom of the production casing 46 (e.g., by a liner hanger 56), and a second well completion 40 (e.g., illustrated in FIG. 5) having a production casing 46 that includes a tapered section 58 disposed between first and second substantially cylindrical sections 60, 62.

As illustrated in FIG. 4, in conventional well completions 40 that use liners 52, an internal tubing 64 positioned within the wellbore 14 (e.g., just above the liner 52 within the production casing 46) may generally align with the liner 52. In contrast, the embodiments described herein may include a downhole tool 66 disposed within the production casing 46 that includes, for example, a specifically designed crossover, special stage cementing equipment, multistage fracturing equipment, and so forth. For example, in certain embodiments, the downhole tool 66 includes internal tubing 68, a crossover 70 adjacent the internal tubing 68, a stop sub 72 adjacent the crossover 70, and a sealbore packer 74 and seal assembly 76 configured to hold the downhole tool 66 in place within, and provide a seal against, the production casing 46.

Again, as illustrated in FIG. 5, the production casing 46 includes the first substantially cylindrical axial section 60 that extends from the top of the wellbore 14 (i.e., an upper axial end of the production casing 46) to the tapered section 58 of the production casing 46, and the first substantially cylindrical axial section 62 that extends from the tapered section 58 of the production casing to a lower axial end 78 of the production casing 46. As such, the first axial section 60 of the production casing 46 is a first tubular section that is longitudinally separated from the second axial section 62 of the production casing 46 by the tapered section 58 of the production casing 46. It will be appreciated that the first axial section 60 of the production casing 46 includes both inner and outer diameters that are larger than that of the second axial section 62 of the production casing 46. As such, the second axial section 62 of the production casing 46 functions similarly to the liner 52 of the embodiment illustrated in FIG. 4. In addition, in certain embodiments, the production casing 46 may include more than one tapered section 58 with each successive tapered section 58 in the downhole direction reducing the inner and outer diameter of the production casing 46.

The systems and methods described herein enable horizontal well completions with specialized multistage fracturing equipment, for example, in dual monobore systems. In addition, the systems and methods described herein enable performance of off-bottom cementing above the target reservoir layer of interest of a geological formation 12. Furthermore, the systems and methods described herein enable completion of the entire well without any further well intervention operations, such as cleaning out of cementing-related equipment and accessories (e.g., plugs, balls, and so forth) from within the various casing of the well, performing cable-conveyed logging operations, running and cementing intermediate casings, and so forth. In addition, the systems and methods described herein enable downhole completions using one drill bit 20 in one run of each section of the wellbore.

Horizontal wells with multistage stimulation equipment that are used in brownfields (i.e., sites previously considered to be contaminated, which are reused in an environmentally sustainable manner) conventionally include three casing strings plus one uncemented liner (see, e.g., FIG. 4). In particular, in such conventional horizontal wells, the producing casing is typically set at the top of the productive formation, with the production casing seat depth selected based upon the pore pressure and wellbore integrity above the target reservoir layer.

In contrast to such conventional horizontal well completion systems, as described herein, the embodiments described herein eliminate the need for intermediate casing from the wellbore construction. Rather, the embodiments described herein replace intermediate casing with a combined casing string (e.g., the production casing 46 illustrated in FIG. 5) that includes upper and lower tubular casing sections 60, 62 longitudinally separated by an intermediate tapered section 58. In certain embodiments, the upper casing section 60 is cemented into place within the wellbore 14, leaving the reservoir layer cased but not cemented, eliminating the need for cleanout operations, but still yielding full inner bore access for further stimulation purposes.

Figure 6:
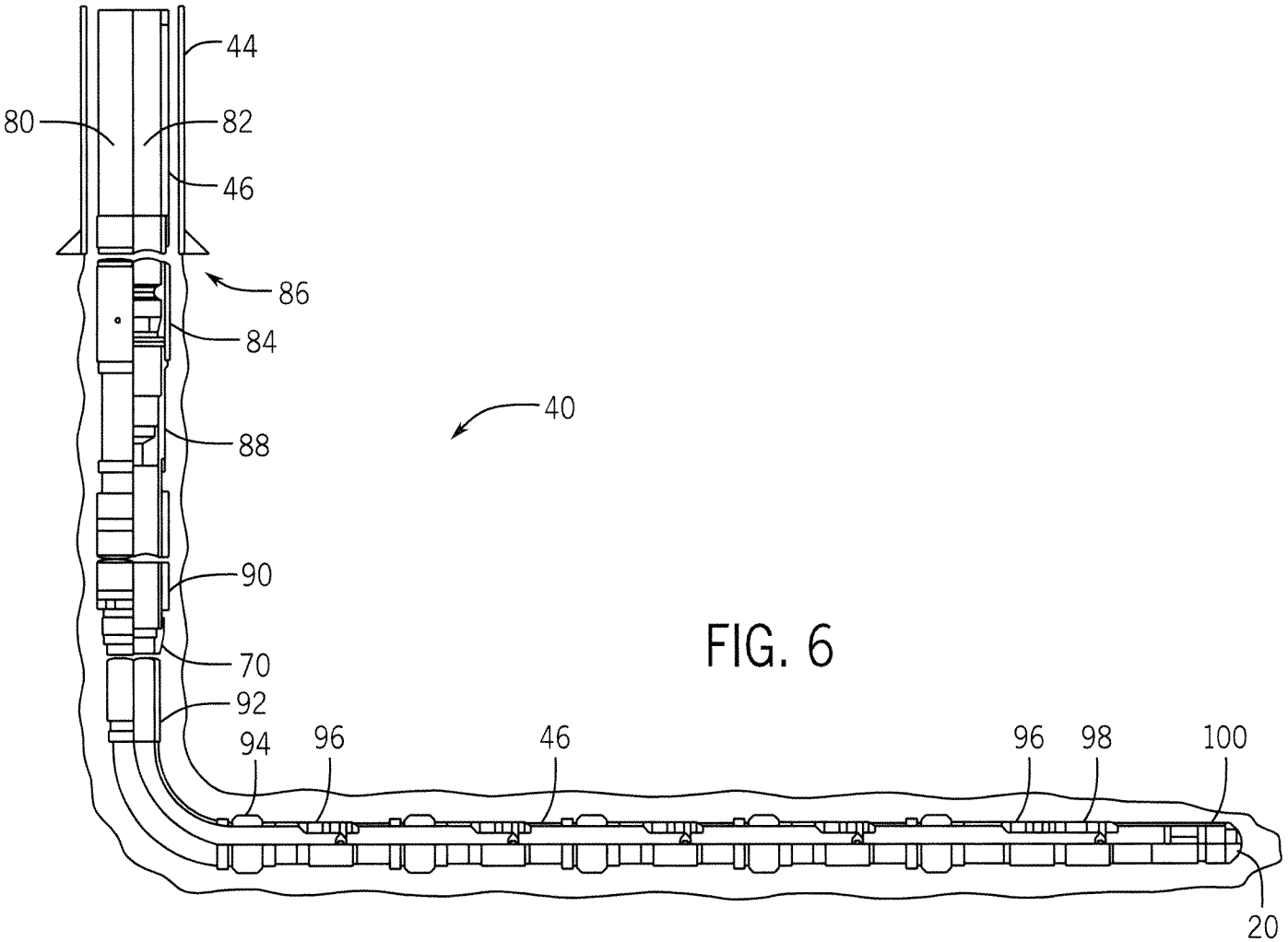
FIG. 6 is a schematic diagram of a horizontal well completion of a drilling system having a dual monobore construction, in accordance with embodiments of the present disclosure.

FIG. 6 is a schematic diagram of a horizontal well completion 40 of a drilling system 10 having a dual monobore construction, in accordance with embodiments of the present disclosure. As illustrated, in certain embodiments, the horizontal well completion 40 includes a surface casing 44 with a production casing (e.g., the production casing 46 illustrated in FIG. 5) disposed directly adjacent the surface casing 44.

In addition, in certain embodiments, the horizontal well completion 40 includes at least one downhole tool 66 that includes, for example, a specifically designed crossover, special stage cementing equipment, multistage fracturing equipment, and so forth, and facilitates the dual monobore construction of the horizontal well completion 40 (i.e., the two bores 80, 82 illustrated within the production casing 46). For example, in certain embodiments, the downhole tool 66 includes a stage cementing valve 84 at an upper axial end 86 of the downhole tool 66. In addition, in certain embodiments, the downhole tool 66 includes an inflatable packer 88 that, for example, includes an inflatable bladder configured to expand against the wellbore 14 to hold the downhole tool 66 in place. In addition, in certain embodiments, the downhole tool 66 includes a landing collar 90 (e.g., a ball catch solid seat landing collar, in certain embodiments) upon which, for example, cement plugs may land. In addition, in certain embodiments, the downhole tool 66 includes a crossover 70 and a seal bore extension 92 (e.g., which may include the sealbore packer 74 and seal assembly 76 illustrated in FIG. 5, in certain embodiments) configured to hold the downhole tool 66 in place and provide a seal.

In addition, in certain embodiments, the downhole tool 66 includes a hydraulic open packer 94 and one or more fracturing valves 96, which help isolate upstream equipment, among other things. In addition, in certain embodiments, the downhole tool 66 also includes an activation sub 98 configured to open and close to enable or block the flow of fluids through the downhole tool 66, and a float shoe 100 (e.g., a rotational float shoe, in certain embodiments) that, for example, prevents reverse flow of fluids through the downhole tool 66.

As described herein, conventional well completion systems and methods include certain techniques that include common steps, such as: (1) drilling, setting, and casing conductor casing 42, (2) directionally drilling a surface section of the wellbore 14 for surface casing 44, (3) running surface casing 44 into the wellbore 14 and cementing the surface casing 44 into place within the wellbore 14, (4) directionally drilling a production section of the wellbore 14 for production casing 46, (5) performing a reaming/conditioning trip (e.g., via a back ream out of the hole (BROOH) procedure) before running production casing 46 into the wellbore 14, (6) running production casing 46 into the wellbore 14 and cementing the production casing 46 into place within the wellbore 14, (7) performing cable-conveyed wireline logging, (8) drilling a horizontal section of the wellbore 14, (9) performing a reaming/conditioning trip (e.g., via a BROOH procedure) before running a production liner 52 into the wellbore 14, and (10) running the production liner 52 into the wellbore 14. It will be appreciated that these steps are conventionally performed in the order presented. In addition, these steps are merely exemplary of conventional well completion steps that are presented for the purpose of contrasting the systems and methods described herein.

For example, the embodiments described herein facilitate the elimination of several steps of the conventional well completion techniques presented above. As but one non-limiting example, the embodiments described herein may include the steps: (1) drilling, setting, and casing conductor casing 42, (2) directionally drilling a surface section of the wellbore 14 for surface casing 44, (3) running surface casing 44 into the wellbore 14 and cementing the surface casing 44 into place within the wellbore 14, (4) directionally drilling a production section of the wellbore 14 for production casing (i.e., the production casing 46 illustrated in FIG. 5), (5) performing a reaming/conditioning trip (e.g., via a BROOH procedure) before running production casing into the wellbore 14, and (6) running production casing into the wellbore 14 and cementing the production casing 46 into place within the wellbore 14 directly adjacent the surface casing 44. It will be appreciated that these steps may be performed in the order presented. In addition, these steps are merely exemplary of the techniques presented herein. In certain embodiments, in step (6), only a portion of the production casing 46 may be cemented into place within the wellbore 14. In particular, a lower portion of the production casing 46 may not be cemented into place within the wellbore 14 (which may be referred to as "off-bottom cementing"), such that the lower portion of the production casing 46 functions somewhat similar to a production liner 52 insofar as the lower portion of the production casing 46 is effectively suspended from the upper (i.e., cemented) portion of the production casing 46. In addition, as opposed to cable-conveyed logging operations that are performed in conventional well completions techniques, the embodiments described herein utilize logging while drilling (LWD) techniques, which obviates the need for cable-conveyed logging.

Figure 7:
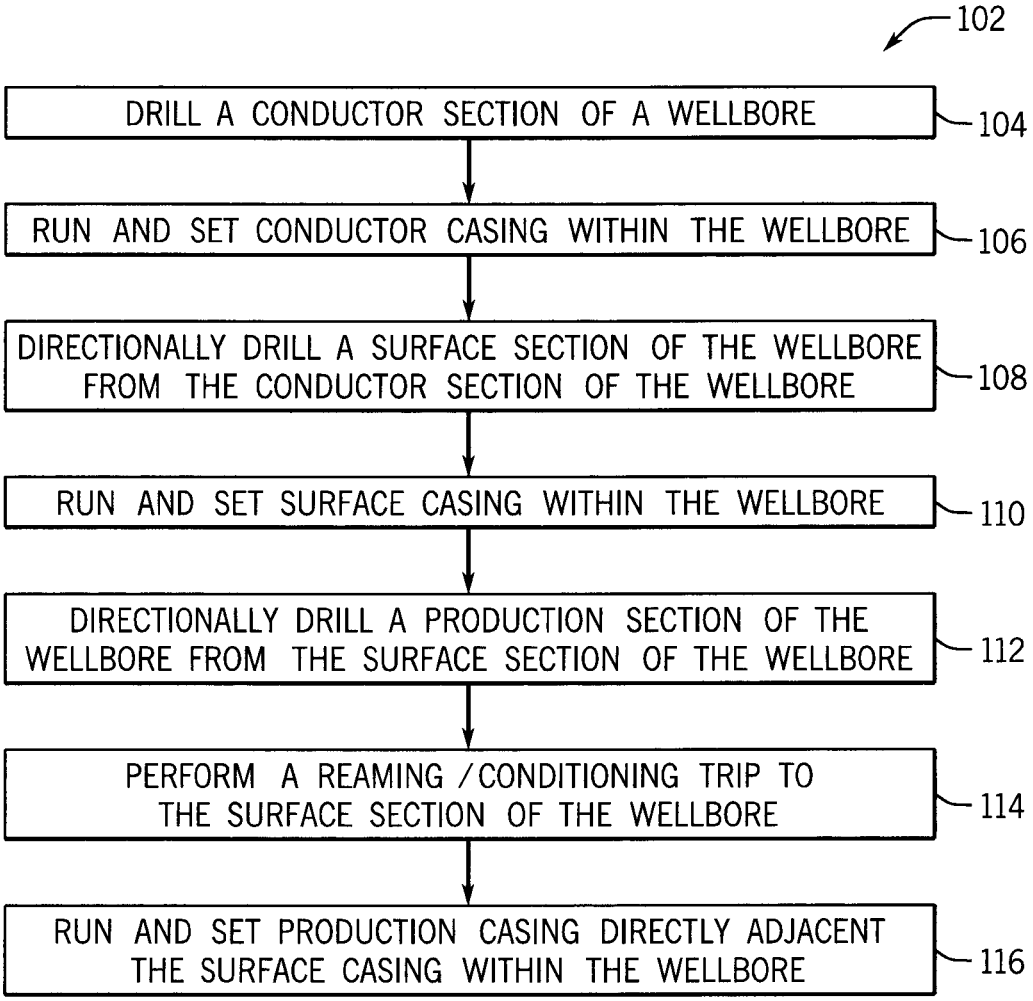
FIG. 7 is a block diagram of a method of completing a horizontal well, in accordance with embodiments of the present disclosure.

Accordingly, FIG. 7 is a block diagram of a method 102 of performing a horizontal well completion 40 (e.g., in a dual monobore well), in accordance with embodiments of the present disclosure. In block 104, a conductor section of a wellbore 14 of a well is drilled. In block 106, conductor casing 42 is run into the wellbore 14 and set (e.g., cemented) into place within the wellbore 14. In block 108, a surface section of the wellbore 14 is directionally drilled from the conductor section of the wellbore 14. In block 110, surface casing 44 is run into the wellbore 14 and set (e.g., cemented) into place within the wellbore 14 (e.g., within the conductor casing 42). In block 112, a production section of the wellbore 14 is directionally drilled from the surface section of the wellbore 14. At least a portion of the production section includes a horizontally drilled section of the wellbore 14. In block 114, a reaming/conditioning trip of the wellbore 14 may be performed (e.g., via a BROOH procedure from the production section of the wellbore 14 to the surface section of the wellbore 14). In block 116, production casing 46 may be run into the wellbore 14 and set into place within the wellbore 14 (e.g., within and directly adjacent the surface casing 44). In certain embodiments, an upper portion of the production casing 46 may be cemented into place, whereas a lower portion of the production casing 46 may not be cemented into place. Regardless of the specific construction of the production casing 46, in certain embodiments, the production casing 46 includes specialized multistage fracturing equipment, among other equipment. In addition, in general, the horizontal well completion method 102 may be performed using only one drill bit 20 in one run of each section (e.g., the conductor section, surface section, and production section) of the well.

The method steps illustrated in blocks 104-116 may be performed in the recited order and, in certain embodiments, certain additional method steps may not be performed as part of the horizontal well completion method 102. For example, in certain embodiments, the horizontal well completion method 102 may be performed without cleaning out of cementing-related equipment from the various casing 42, 44, 46, of the wellbore 14. In addition, in certain embodiments, the horizontal well completion method 102 may be performed without running and setting intermediate casing 50 within the surface casing 44 before running and setting the production casing 46 into place within the wellbore 14. Rather, again, the production casing 46 may instead be set in place directly adjacent the surface casing 44. In addition, in certain embodiments, the horizontal well completion method 102 may be performed without suspending a production liner 52 from the production casing 46 to complete the well. Rather, in contrast, in certain embodiments, an upper portion of the production casing 46 may be cemented into place within the wellbore 14, and a lower portion of the production casing 46 may not cemented into place within the wellbore 14, such that the production casing 46 is somewhat similar to a conventional production casing and production liner combination. In addition, in certain embodiments, the horizontal well completion method 102 may be performed without performing cable-conveyed logging operations relating to the wellbore 14 before running and setting the production casing 46 into place within the wellbore 14.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method, comprising:

drilling a conductor section of a wellbore of a well;

running and cementing conductor casing within the wellbore;

directionally drilling into a surface section of the wellbore from the conductor section of the wellbore;

running and cementing surface casing within the wellbore;

directionally drilling into a production section of the wellbore to the surface section of the wellbore;

performing a reaming/conditioning trip to the surface section of the wellbore;

running production casing comprising an upper portion, a lower portion, a tapered section separating the upper portion and the lower portion, and multistage fracturing equipment disposed therein; and cementing the upper portion of the production casing within the wellbore directly adjacent the surface casing to complete the well while leaving the lower portion uncemented, wherein the well is completed without cleaning out of cementing-related equipment from the casing of the wellbore.

2. The method of claim 1, wherein the method is performed in the recited order.

3. The method of claim 1, wherein the method does not comprise running and cementing intermediate casing within the surface casing before running and cementing the production casing within the wellbore.

4. The method of claim 1, wherein the method does not comprise suspending a production liner from the production casing to complete the well.

5. The method of claim 1, wherein the method does not comprise performing cable-conveyed logging operations relating to the wellbore before running and cementing the production casing within the wellbore.

6. The method of claim 1, wherein the completed well comprises a dual monobore well.

7. The method of claim 1, wherein the method is performed using one drill bit in one run of each section of the well.

8. A method, comprising:

drilling a conductor section of a wellbore of a well;

running and cementing conductor casing within the wellbore;

directionally drilling into a surface section of the wellbore from the conductor section of the wellbore;

running and cementing surface casing within the wellbore;

directionally drilling into a production section of the wellbore to the surface section of the wellbore;

performing a reaming/conditioning trip to the surface section of the wellbore;

running production casing comprising an upper portion, a lower portion, a tapered section separating the upper portion and the lower portion, and multistage fracturing equipment disposed therein; and cementing the upper portion of the production casing within the wellbore directly adjacent the surface casing to complete the well while leaving the lower portion uncemented, wherein the well is completed without cleaning out of cementing-related equipment from the casing of the wellbore, without running and cementing intermediate casing within the surface casing before running and cementing the production casing within the wellbore, and without suspending a production liner from the production casing to complete the well.

9. The method of claim 8, wherein the method is performed in the recited order.

10. The method of claim 8, wherein the method does not comprise performing cable-conveyed logging operations relating to the wellbore before running and cementing the production casing within the wellbore.

11. The method of claim 8, wherein the production casing comprises a first tubular section longitudinally separated from a second tubular section by a tapered section.

12. The method of claim 8, wherein the completed well comprises a dual monobore well.

13. The method of claim 8, wherein the method is performed using one drill bit in one run of each section of the well.

14. A method, comprising:

drilling a conductor section of a wellbore of a well;

running and cementing conductor casing within the wellbore;

directionally drilling into a surface section of the wellbore from the conductor section of the wellbore;

running and cementing surface casing within the wellbore;

directionally drilling into a production section of the wellbore to the surface section of the wellbore;

performing a reaming/conditioning trip to the surface section of the wellbore;

running production casing comprising an upper portion, a lower portion, a tapered section separating the upper portion and the lower portion, and multistage fracturing equipment disposed therein; and cementing the upper portion of the production casing within the wellbore directly adjacent the surface casing to complete the well while leaving the lower portion uncemented, wherein the well is completed without cleaning out of cementing-related equipment from the casing of the wellbore, without running and cementing intermediate casing within the surface casing before running and cementing the production casing within the wellbore, without performing cable-conveyed logging operations relating to the wellbore before running and cementing the production casing within the wellbore; and without suspending a production liner from the production casing to complete the well.

15. The method of claim 14, wherein the method is performed in the recited order.

16. The method of claim 14, wherein the completed well comprises a dual monobore well.

17. The method of claim 14, wherein the method is performed using one drill bit in one run of each section of the well.

* * * * *